United States Patent [19]

Gasser et al.

[11] 4,329,840

[45] May 18, 1982

[54] METHOD OF AND APPARATUS FOR FEEDING A FIBRE TOW TO A TEXTILE MACHINE

[75] Inventors: Hermann Gasser, Zurich; Paolo Di Benedetto, Uster; Johann W. Ferri, Greifensee, all of Switzerland

[73] Assignee: Luwa AG, Zurich, Switzerland

[21] Appl. No.: 164,321

[22] Filed: Jun. 30, 1980

[30] Foreign Application Priority Data

Jul. 10, 1979 [CH] Switzerland ..... 6417/79

[51] Int. Cl.[3] ..... D01H 15/00; D01H 13/04; B65H 51/16; B65H 17/32

[52] U.S. Cl. ..... 57/279; 57/90; 57/333; 57/350; 226/97

[58] Field of Search ..... 226/7, 97; 57/90, 350, 57/279, 280, 333

[56] References Cited

U.S. PATENT DOCUMENTS

| | | | |
|---|---|---|---|
| 3,951,321 | 4/1976 | Heusser | 226/97 |
| 4,005,566 | 2/1977 | Hawkins | 57/90 X |
| 4,114,790 | 9/1978 | Sighieri et al. | 226/97 X |
| 4,181,247 | 1/1980 | McFall | 226/97 |

*Primary Examiner*—John Petrakes
*Attorney, Agent, or Firm*—Werner W. Kleeman

[57] ABSTRACT

In a method of and apparatus for feeding a tow to a textile machine, the leading end of the tow is automatically twisted by a vortical gas flow during transport through a tube to the machine. Preferably the vortical gas flow is also used to draw the tow through the tube.

6 Claims, 2 Drawing Figures

METHOD OF AND APPARATUS FOR FEEDING A FIBRE TOW TO A TEXTILE MACHINE

CROSS REFERENCE TO RELATED CASE

This application is related to the commonly assigned copending U.S. application Ser. Nos. 06/164,066, filed June 30, 1980, 06/164,067, filed June 30, 1980, 06/164,068, filed June 30, 1980 and 06/164,292, filed June 30, 1980.

BACKGROUND OF THE INVENTION

The invention relates to a method of and apparatus for feeding a fibre tow or strand-like material, especially a sliver to a textile machine.

It is known, in textile machines which process tow or sliver material supplied in cans, for the tows to be transported from the cans to the machine by a flow of transport air through transport tubes. The air flow is generated by a source of suction provided at the machine, and such arrangements, which can replace conventional creels, usually function very satisfactorily.

In the aforementioned copending application Ser. No. 06/164,292 assigned to the assignees hereof it is proposed to transfer the leading end of a tow or sliver to a textile machine by means of a flow of feed air, which is stronger than the normal flow of transport air. The leading end is, for this purpose located at a position of readiness at the entry to the transport tube.

However, in order to thread such a leading end of tow into the textile machine, manual work on the part of an operator is still required. A sufficient length of the leading end of the tow must be twisted by hand before it can be threaded into the machine, or into the transport elements and/or working elements of the machine. This twisting imparts increased tensile strength to the leading end of the tow, apart from making it more compact in form and easier to thread. However, this work slows down the operation of threading, and particularly with large machines such as flyers with over a hundred spindles, this machine-tending time is of considerable economic significance.

SUMMARY OF THE INVENTION

The object of the invention is to make this twisting preparation of the leading end of the tow at least partly automatic so as to simplify machine-tending and reduce machine downtime.

According to the present invention there is provided a method of feeding a fibre tow or sliver through a tube to a textile machine wherein a twist is imparted to the leading end of the tow during movement towards the textile machine by a vortical gas flow incident on the surface of the tow.

The invention also provides apparatus for feeding a fibre tow or sliver to a textile machine from a can, such apparatus including a transport tube, and an air injector on the tube for connection to a source of compressed air, the injector being effective to pass compressed air to the interior of the tube so as to form a vortical air flow therein.

With the invention, the leading end of the tow automatically receives increased twisting and thus tensile strength before it arrives at the textile machine, so that the work of the operator is limited to the threading of the tow into the machine.

Preferably the vortical flow is also used for generating the feed flow and thus for transporting the leading end of the tow towards the textile machine. A secondary vortical flow will then develop in the feed flow, so that the tow receives a twist in the parts adjoining the leading end. Such a twist is especially advantageous where the tow travels a large distance in a transport tube, while if the operator has to pull more tow out of the can, through the transport tube, for the purpose of threading the twisted leading end, it is useful that tensile strength of the part of the tow pulled through the transport tube will be increased by the twisting.

BRIEF DESCRIPTION OF THE DRAWING

In order that the invention may be more clearly understood, the following description is given by way of example only with reference to the accompanying drawings in which.

DETAILED DESCRIPTION OF THE PREFERRED EMBODIMENTS

Figure 1:
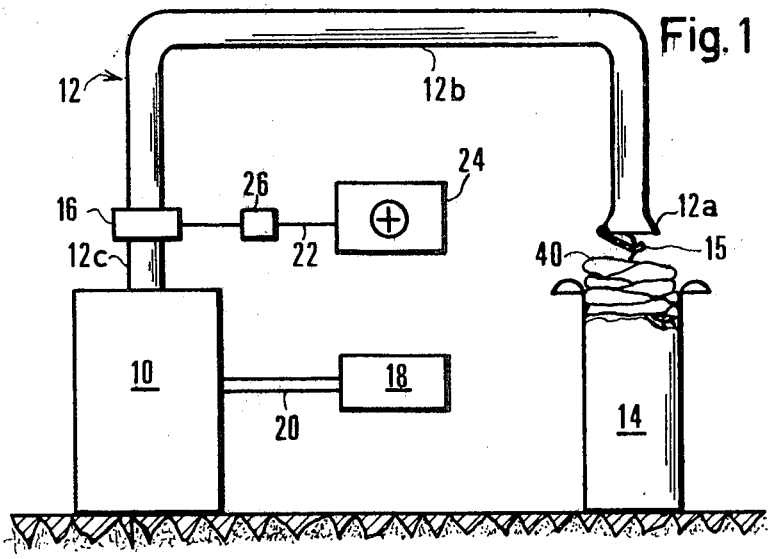
FIG. 1 is a schematic view of a transport system including apparatus of the invention.

A textile machine 10, more particularly a spinning machine, uses textile tow or strand-like material, typically sliver, and requires for each working position, such as a spindle, a can 14 which contains a tow or sliver. Tow or sliver is fed to the machine through transport tubes such as the tube 12. The transport tube 12 terminates in the machine 10 directly in front of, for instance, a drawing unit.

In order to convey the tow from the cans to the machine, a source of suction 18 is provided in respect of all the transport tubes 12. This source generates, via a connection 20, a flow of air towards the spinning machine 10 through the transport tubes.

A greater suction, corresponding to a stronger air flow is required for initially drawing the tow into the transport tube 12, than for transporting the tow during its processing in the textile machine. Such greater suction is generated by a compressed air injector 16 located on the transport tube 12 adjacent to the machine 10. The compressed air injector 16 is connected to a compressed air reservoir 24 via a pressure line 22, which can be shut off by means of a valve 26.

A hook 15 is located at the entry 12*a* to the transport tube 12 to hold the tow or sliver or the like when taken from the can 14, in a position of readiness.

Figure 2:
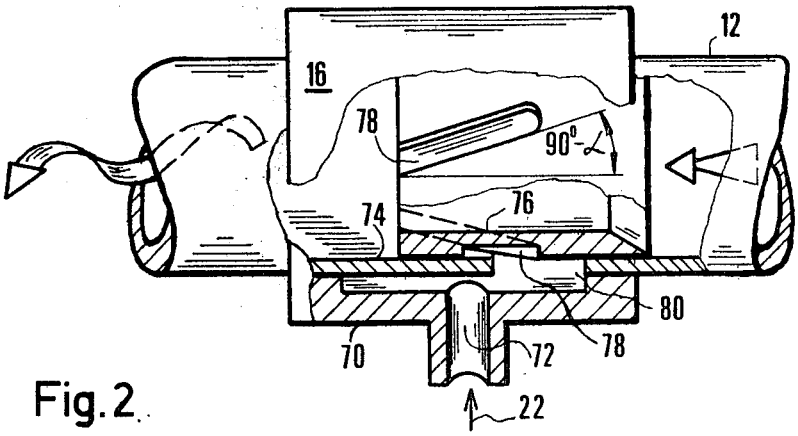
FIG. 2 illustrates an embodiment of a rotating flow injector for use in the apparatus of FIG. 1.

Preferably the compressed air injector 16 is a vortical flow injector, as can be seen in FIG. 2 where it is shown in section on an enlarged scale.

As shown in FIG. 2, the compressed air injector 16 provides an annular chamber 80 around the transport tube 12. At its outside, the annular chamber is bounded by a cylindrical sleeve 70, which has a bore 72 to which the pressure line 22 for the compressed air is attached. Within the sleeve 70 the transport tube 12 is split into two sections of different diameters. The section of smaller diameter, 76, is at the feed side 12*b* of the transport tube 12 and has air guide means in the form of grooves 78, uniformly spaced on its external periphery. The grooves 78 in the form of channels terminate in the annular chamber 80. The section of larger diameter, 74, surrounds and contacts the section of smaller diameter 76 over part of the length of the grooves 78, and it is attached to the downstream part 12*c* of the transport tube 12. The grooves 78, which direct the air are at a pitch angle $\alpha$ of, for instance 60°-80°, according to the amount of twisting desired. The length of the part 12*c* of the transport tube between the compressed air injector 16 and the machine 10 measured from the plane of the open ends of the grooves, is at least four times, and preferably six times, the tube diameter. The grooves 78, impart an approximately spiral flow to the compressed air in the downstream part of the transport tube, that is to say, a primary, vortical flow is formed.

Before starting up the machine, a leading end of tow or sliver 40 from the can 14, is attached to the hook 15 at the entry 12*a* of each transport tube 12 and is thus brought into the readiness position. The spinning operator then opens the hand-valve 26 and compressed air enters the injector 16 and flows through tube part 12*c*, towards the spinning machine 10. The column of air in the part 12*b* of the transport tube 12 upstream of the injector is thus moved towards the spinning machine 10 and a secondary or feed flow is set up, in which a secondary vortex is induced which increases in intensity closer to the injector. The feed flow set up at the intake 12*a* of the transport tube 12 picks up the leading end of the tow 40, which is held on the hook 15 and carries it into the tube 12 whereupon more tow is pulled from the can. When the leading end reaches the drawing unit of the machine 10, the compressed air injector 16 is cut off by the valve 26. During its movement through the transport tube 12 and particularly when passing through the injector, twist is imparted both to the leading end of the tow or sliver and also to adjacent parts due to the vortical flow which acts on the tow surface. This twist is present in the leading end and extends due to the secondary vortical flow, over an appreciable part of the length of the tow which is picked up by the secondary flow and is in the tube. In order to give a sufficient effective length to the secondary vortical flow, the length of the part 12*b* of the tube 12 is preferably at least three times that of the part 12*c*. By virtue of its thus increased tensile strength the tow can be pulled through the drawing unit by hand and further threaded-in, as required by the particular type of machine. This procedure is repeated at each working position. On starting up the machine 10, the fan 18 takes over the generation of the suction and thereby transports, by means of the resulting nonvortical flow, the tows from the cans 14, through the transport tubes 12, into the machine 10.

The application of the method and apparatus of the invention is not, of course, limited to tow or sliver feeds on spinning machines; it can in principle be used for all textile machines which process tow or the like.

While there are shown and described present preferred embodiments of the invention, it is to be distinctly understood that the invention is not limited thereto, but may be otherwise variously embodied and practiced within the scope of the following claims.

Accordingly, we claim:

1. A method of feeding a fiber sliver through a tube to a textile machine, comprising the steps of:

creating a primary vortical flow at a predetermined location of a tube;

creating a feed flow at an infeed location of the tube located upstream of said predetermined location for feeding a sliver through the tube;

holding in readiness the sliver at the infeed location;

seizing the sliver by means of the feed flow and transporting such sliver through the tube;

inducing in the feed flow by means of the primary vortical flow a secondary vortical flow; and imparting twist to the sliver by the action of the primary vortical flow and the secondary vortical flow upon the surface of the sliver while the sliver passes through the tube.

2. An apparatus for feeding a sliver to a textile machine from a sliver can, comprising:

a transport tube having a tube wall and a tube lengthwise axis;

an air injector carried by said transport tube;

means providing a source of compressed air;

said air injector having connector means for connection thereof to said source of compressed air; and air guide means substantially uniformly distributed about said tube wall and piercingly extending through said tube wall for passing compressed air from said source into said transport tube in order to form a vortical flow therein for imparting twist to the sliver as it moves through the transport tube.

3. The apparatus as defined in claim 2, wherein:

said air injector comprises an annular chamber located around said transport tube;

said connector means leading to and being in flow communication with said annular chamber;

said air guide means including grooves extending from said annular chamber through the tube wall into said transport tube; and said grooves being inclined with respect to the lengthwise axis of the transport tube.

4. The apparatus as defined in claim 3, wherein:

said grooves comprise a plurality of channels essentially uniformly distributed around the periphery of said transport tube; and said plurality of channels each having an angle of inclination in a range of about 10° to 30° with respect to the lengthwise axis of the tube.

5. The apparatus as defined in claim 4, wherein:

at the region of said air injector said transport tube comprises respective sections of larger and smaller diameter;

said grooves being located at a surface of an end region of said section of smaller diameter;

said grooves having ends opening into said chamber; and said section of larger diameter surrounding and contacting said section of smaller diameter over part of the length of said grooves in order to cover said part of said grooves.

6. The apparatus as defined in claim 2, wherein:

said transport tube possesses a length upstream of said air injector which is at least three times the length of said transport tube at a location downstream of said air injector; and the length of said transport tube downstream of the air injector amounting to at least four times the internal diameter of said transport tube.

* * * * *